United States Patent [19]

Golay et al.

[11] Patent Number: 4,606,271

[45] Date of Patent: Aug. 19, 1986

[54] FUSE WITH A PIERCING HEAD FOR A PROJECTILE

[75] Inventors: Jean-Pierre Golay, Viry, France; Denis Jaunin, Geneva, Switzerland

[73] Assignee: Mefina S.A., Fribourg, Switzerland

[21] Appl. No.: 587,051

[22] Filed: Mar. 7, 1984

[30] Foreign Application Priority Data

Mar. 7, 1983 [CH] Switzerland ..... 1218/83

[51] Int. Cl.[4] ..... F42C 11/02; F42C 9/14; F42C 15/24; F42C 15/34

[52] U.S. Cl. ..... 102/210; 102/271; 102/255; 102/249

[58] Field of Search ..... 102/210, 271, 249, 255, 102/254, 262, 264, 517, 518

[56] References Cited

U.S. PATENT DOCUMENTS

| | | | |
|---|---|---|---|
| 2,129,692 | 9/1938 | Hottinger | 102/271 |
| 2,789,508 | 4/1957 | Rove et al. | 102/255 |
| 3,128,705 | 4/1964 | Jasse | 102/210 |
| 3,967,556 | 7/1976 | Post et al. | 102/210 |

*Primary Examiner*—Charles T. Jordan
*Assistant Examiner*—Michael J. Carone
*Attorney, Agent, or Firm*—Anthony A. O'Brien

[57] ABSTRACT

The projectile fuse comprises a piezoelectric generator located forward of a piercing part (2) and formed by a striker (5), a hammer (6) and a crystal (8). The firing device comprises a watch movement (11) providing a muzzle safety and making possible the positioning of a rotary support (15) for at least one primer (24). A part (2) of material with high mechanical resistance acts as the piercing head for the projectile after the dislodging of the electric generator at the moment of impact and effectively protects the watch movement (11) and the rotary support (15).

6 Claims, 4 Drawing Figures

FUSE WITH A PIERCING HEAD FOR A PROJECTILE

When it is desired that a projectile be able to destroy a hard material target, for example, a concrete bunker or an armored vehicle, it should be equipped with a piercing head able to penetrate the hard material and protect the projectile percussion and firing device. Actually, the projectile should be equipped with a fuse producing a delayed firing so that the explosion occurs only after the projectile penetrates the target. Instantaneous firing would hardly produce damage to an armored target.

Up to the present, the entire projectile head was enclosed in a protective piece of material with high mechanical resistance, only the striker optionally being located ahead of this protective head. Such a design is heavy and, at the same time, expensive.

U.S. Pat. No. 2,485,887 and French Pat. No. 2,219,396 each show a design in which the entire firing device is located behind the piercing part, only a percussion contact being located ahead of this part.

Electric firing by a pulse supplied by a piezoelectric generator is known, for example, from German Pat. No. 25.58.836.

This invention aims to improve a fuse of said type and make possible a design that is effective, less bulky, lighter and less expensive than known designs.

For this purpose, this invention has as its object a fuse with a piercing head for a projectile, comprising an electric firing device and means for delaying the firing, this device and these means being placed on the inside or back of a piercing part of high resistance material, characterized in that it comprises a piezoelectric generator intended to be activated at impact to supply electric energy for firing, this generator being placed ahead of the piercing part and electrically connected to the firing device.

The accompanying drawings shows diagrammatically and by way of example an embodiment of the fuse, object of the invention.

Figure 1:
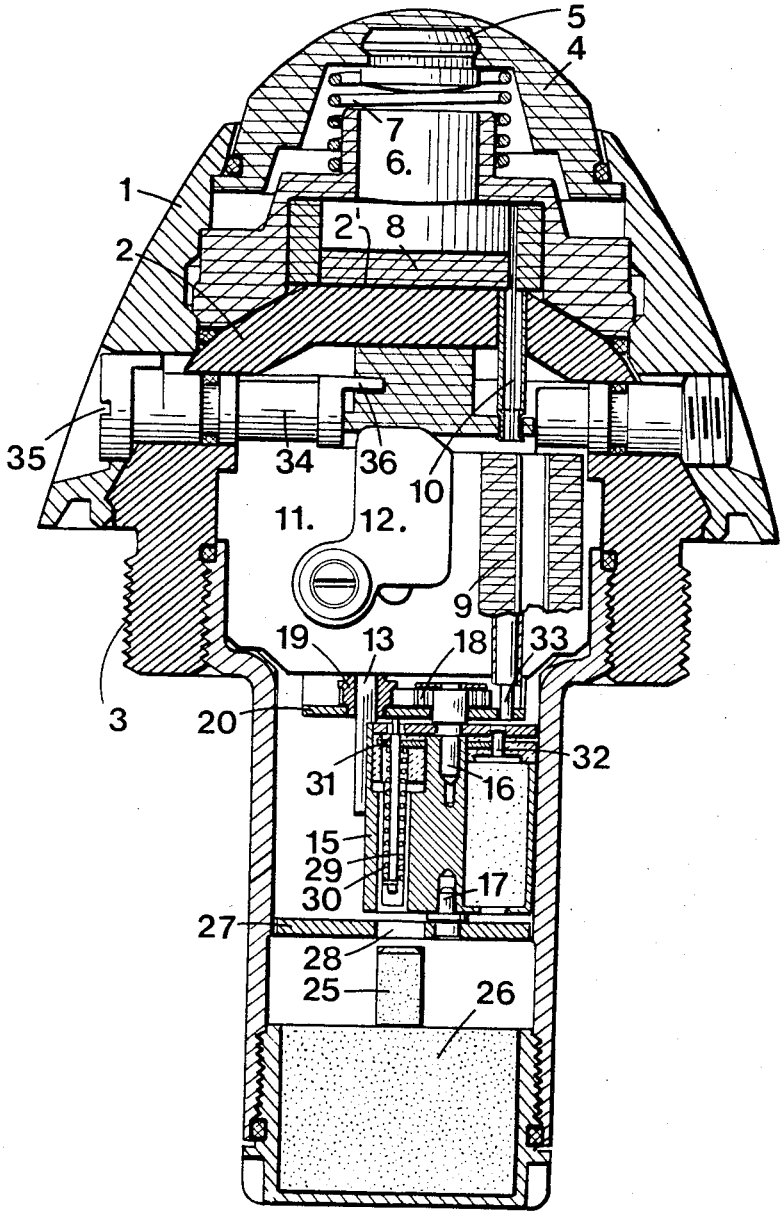
FIG. 1 is an axial section of this embodiment, showing the position occupied by the various elements of the fuse, before the start of the shot.

The fuse shown comprises an annular part 1, fastened by crimping on a protective part 2 exhibiting an outside thread 3 making it possible to fasten the unit on the body (not shown) of a projectile.

Annular part 1 surrounds an electric firing device, comprising a striker 5 placed in a cap 4 and intended to strike a hammer 6, against the action of a spring 7 at the moment of impact. The impact produced on hammer 6 is applied to a piezoelectric element 8, which supplies a voltage peak under the effect of the impact. This piezoelectric element rests on the front face 2' of protective part 2, which constitutes an anvil and at the same time a ground potential electrode, while hammer 6 constitutes the other electrode, which is connected by a contact pin 10 to a stepdown transformer 9.

The fuse further comprises a time delay device 11, provided with a plunger 12, which can move during the start of the shot to tighten a spring. This latter acts like a main spring of a watch movement contained in timer 11, a movement that is of known design and which therefore will not be shown in detail. A movement of this type, moreover, is described in Swiss Pat. No. 691/80-3. When the time defined by the watch movement has passed, the timer releases, by means of a safety member 37, a stop element, consisting of a rod 13, sliding in an axis parallel to that of the fuse, this rod 13 being subjected to the action of a return spring 14 (FIG. 2).

Rod 13 constitutes a stop element for a rotary member or mobile part 15 in the form of a rotor mounted to pivot on a journal 16 and pivot 17.

Figure 3:
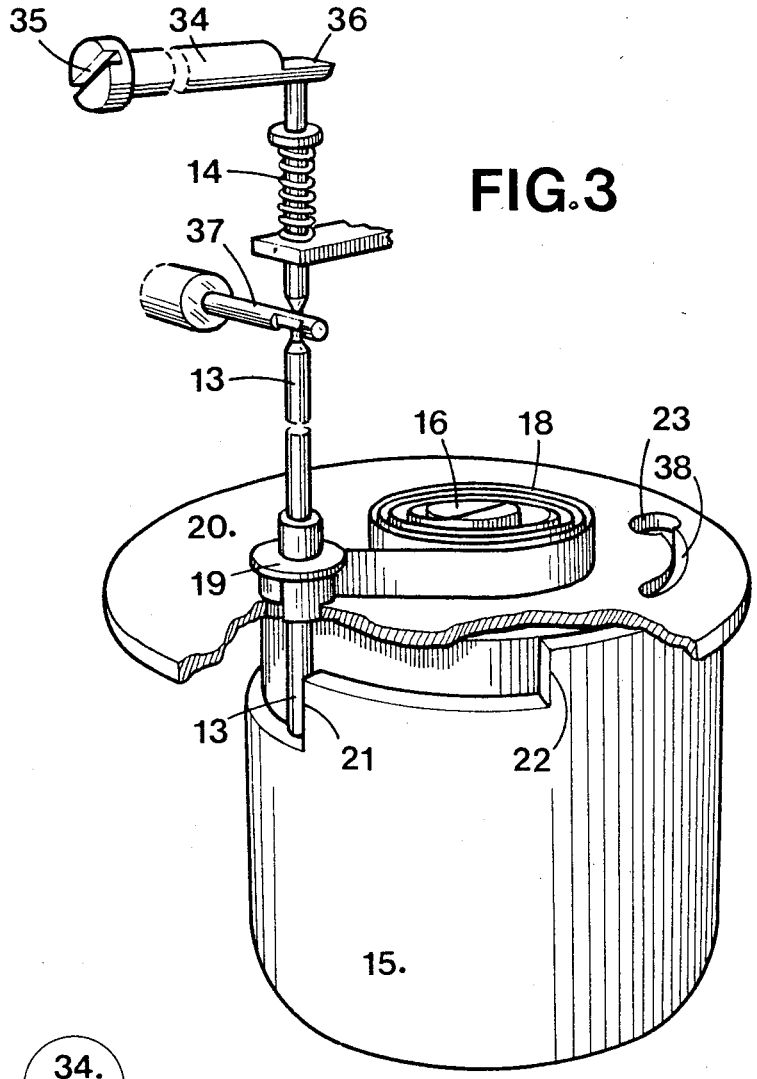
FIG. 3 is a diagrammatic view in perspective with parts removed, showing a part of the delay mechanism and the mobile part.

As shown in FIG. 3, journal 16 is solid with a spiral spring 18, whose outside end is fastened to a bearing 19 of rod 13, this bearing being carried by a disk 20. This spring 18 pulls rotor 15 in a clockwise direction and the latter is held in its rotation by stop rod 13, which works with a shoulder 21, provided on the periphery of the rotor to lock it in safety position. Shoulder 21 is followed by a shoulder 22 which makes it possible to define a first active position of rotor 15 by strike against rod 13. If rod 13 is moved enough to disengage shoulder 22, the rotor can rotate further to reach a second active position.

Figure 2:
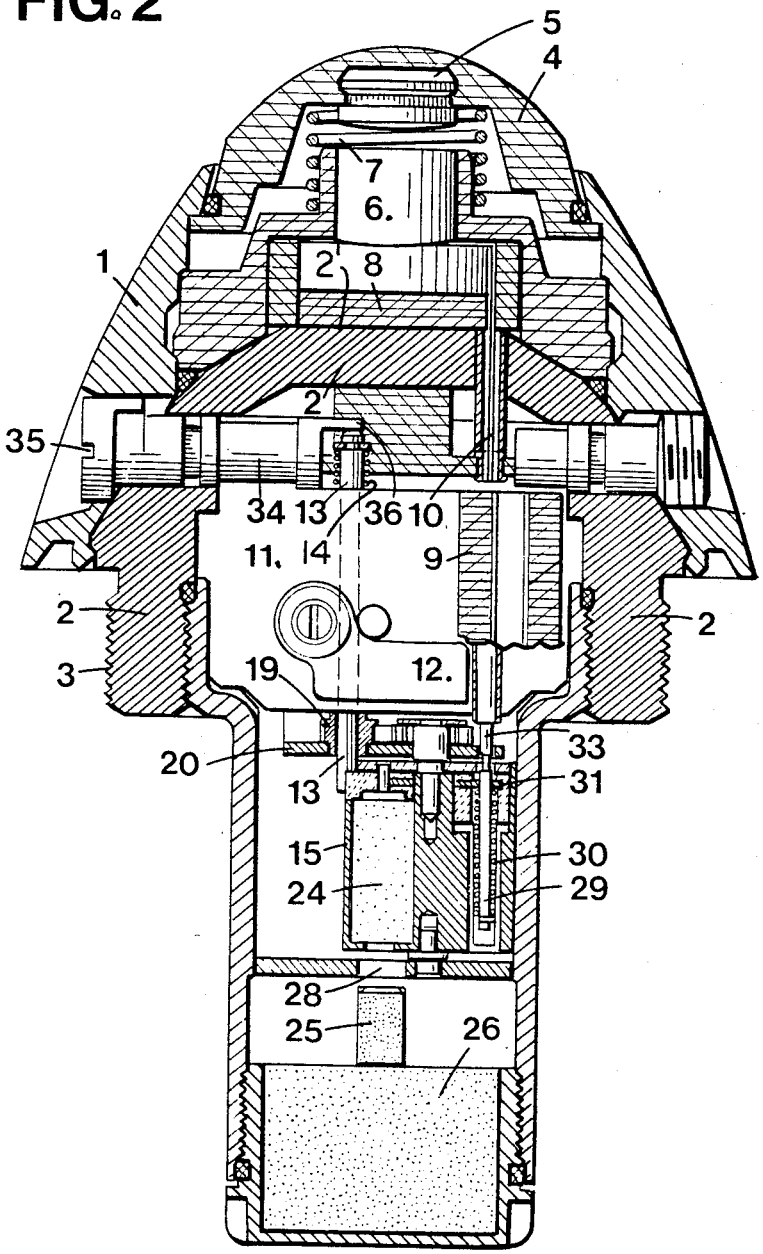
FIG. 2 is a view similar to FIG. 1, showing the fuse in armed position, after the starting of the shot.

Rotor 15 contains two electric primers, of which only 24 can be seen in FIGS. 1 and 2. These primers exhibit different characteristics, one being provided for an instantaneous firing and the other for a delayed firing of the projectile. Below rotor 15 is a pyrotechnic chain 25, 26 intended to impart firing to the explosive charge of the projectile.

Component 25 of the pyrotechnic chain is separated from rotor 15 by a metal disk or plate 27 and is located opposite an orifice 28, made in this disk.

The contact for bringing voltage to primer 24 consists of a contact member or rod 29, subjected to the action of a spring 30 and working with a contact strip 31 which touches pin 32 for bringing the voltage to primer 24. In the position in FIG. 1, contact rod 30 rests on disk 20 which is grounded, so that the ignition terminals of primer 24 are short-circuited, hich makes the device completely neutral in relation to the voltages induced, for example, by electromagnetic devices. Further, no primer is opposite hole 28, since the safety position is involved. The arrangement is the same for the other primer, which is not shown but which also has an elastic contact rod.

In the position shown in FIG. 2, stop rod 13 has moved upward and rotor 15 has turned under the action of spring 18 to bring primer 24 opposite hole 28. At the same time, contact rod 29 has slid under disk 20 to the moment when it is opposite an opening 23 of disk 20 which it goes through under the action of spring 30 to come in contact with a current lead consisting of a conductor 33, this latter is connected to stepdown transformer 9. At the moment of impact, the voltage produced by the piezoelectric element is applied to primer 24 by going through pin 10, transformer 9, conductor 33, rod 29 and strip 31.

Control of the selection of one or the other of the primers is made by acting on a selector or rotating element 34 exhibiting a slotted head 35. This element exhibits an end 36 intended to limit the travel of stop rod 13. The rod 13 will be understood to be initially locked by the member 37 of the time delay device and thereafter released following the launch of the projectile. In the position illustrated in FIG. 3, end 36 prevents any movement of rod 13 upward making it possible to release shoulder 21 from rotor 15. If element 34 is rotated a half turn, as illustrated in FIGS. 1 and 2, part 13 can slide to release shoulder 21 and constitute a stop for shoulder 22 to define a first position for stopping rotor 15. When element 34 is rotated only a quarter of a turn, end 36 is outside the trajectory of rod 13, so that its lower end is placed higher than shoulder 22. Rotor 15 can then rotate until contact rod 29 strikes against the end of a slot 38 extending opening 23. In this position, the contact rod of the other primer goes through opening 23 after having slid under disk 20.

Figure 4:
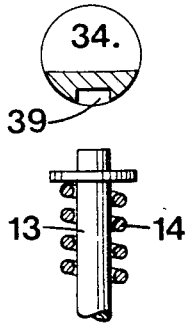
FIG. 4 shows a detail of FIG. 3.

As FIG. 4 shows, end 36 exhibits a groove or housing 39 opposite rod 13, in which this rod would be housed in the case where it would be accidentally released, so as to prevent any rotation of element 34 and to prohibit the arming of the fuse.

Element 34 is, of course, placed in its selection position before the start of the launch or shot, so that after the launching of the projectile and after the delay provided by timing mechanism 11, rod 13 is moved upward, under the action of spring 14 and occupies, according to the preselection, a stop or disengagement position for shoulder 22 of rotor 15.

The latter rotates very rapidly under the action of its spring 18, so that the time for positioning one or the other primer remains almost the same, regardless of the preselected primer.

It is found that regardless of the preselected primer, the other primer is short-circuited by its rod 29 which is either resting against plate 20 or in contact with this plate at the end of slot 38.

During impact on a hard target, striker 5 and hammer 6 act on the piezoelectric element to produce an ignition voltage which is transmitted almost instantaneously to the primer which has been selected. The generator is then dislodged by the shock of the impact, but the firing device is protected by armor part 2 while the latter acts as a piercing head by penetrating the target. Firing then occurs normally. In the case where the instantaneous firing primer has been selected, armor part 2 no longer has a role of protection to play, but it makes it possible to use only a single projectile model that is suited both for instantaneous ignition and for delayed ignition after penetrating a hard material.

We claim:

1. In a fuse for a projectile having a target piercing head of armor-piercing material, an electric firing device and means for delaying the firing, the improvement wherein, said electric firing device includes an impact-actuated strike, hammer and piezoelectric element all fully disposed forward of said piercing head, said piercing head having a forward-most substantially planar medial area providing an anvil for said piezoelectric element, said piezoelectric element juxtaposed said piercing head forward-most anvil area, said means for delaying the firing including a time delay device initiated during launch of the projectile, an electric primer, said time delay device and primer disposed rearwardly of said piercing head medial area, and means directly electrically connecting said piezoelectric element to said primer for igniting said primer by means of energy generated by said piezoelectric element.

2. A fuse according to claim 1 including, two of said electric primers exhibiting different characteristics, a rotary member containing said primers, said rotary member subjected to a return force and displaceable between three positions, a pyrotechnic chain adjacent said rotary member, said rotary member three positions comprising a safety position with no one said primer juxtaposed said pyrotechnic chain and two active positions with alternate ones of said two primers respectively juxtaposed said pyrotechnic chain, said time delay device providing a delayed time in the rotation of said rotary member from said safety position to one of said active positions, a selector operable to limit the rotation of said rotary member to a desired one of said two active positions, and a stop element communicating between said selector and rotary member and shiftable to one of three positions upon operation of said selector to alternately lock said rotary member in said safety position or one of said two active positions.

3. In a fuse for a projectile having a target piercing head of armor-piercing material, an electric firing device and means for delaying the firing, the improvement wherein, said electric firing device includes an impact-actuated striker, hammer and piezoelectric element all disposed forward of said piercing head, said piercing head having a substantially planar medial area providing an anvil for said piezoelectric element, said means for delaying the firing including a time delay device initiated during launch of the projectile, two electric primers exhibiting different characteristics, a rotary member displaceable about an axis parallel to that of the fuse and containing said primers, said rotary member subjected to a return force and displaceable between three positions, a pyrotechnic chain adjacent said rotary member, said rotary member three positions comprising a safety position with no one said primer juxtaposed said pyrotechnic chain and two active positions with alternate ones of said two primers respectively juxtaposed said pyrotechnic chain, said time delay device and primers disposed behind said piercing head, said time delay device providing a delayed time in the rotation of said rotary member from said safety position to one of said active positions, a selector operable to limit the rotation of said rotary member to a desired one of said two active positions, a stop element communicating between said selector and rotary member and shiftable to one of three positions upon operation of said selector to alternately lock said rotary member in said safety position or one of said two active positions, means electrically connecting said piezoelectric element to said primers, a metal plate adjacent said rotary member and providing with an opening, said electrically connecting means including a conductor behind said piercing head rearwardly terminating opposite said plate opening, each said primer having a contact member spring-urged against said plate when said rotary member is in said safety position and disposed through said plate opening when said rotary member is in an active position, said contact member when disposed through said plate opening engaging said conductor to form one current lead to said primers and said rotary member including a metal part electrically connected to said plate to form the other current lead to said primers.

4. A fuse according to claim 3 wherein, said plate opening comprises an arc-shaped slot whose center of curvature coincides with the axis of rotation of said rotary member, said slot receiving said primer contact member which is opposite said opening when said rotary member is in one said active position, and said contact member striking against the end of said slot to define another of said active positions of said rotary member.

5. A fuse according to claim 4 wherein, said stop element comprises a sliding rod with an axis parallel to the fuse, said selector including a rotating pin disposed transverse to the axis of the fuse and having an end adapted to engage said sliding rod to limit the axial travel thereof.

6. A fuse according to claim 5, wherein said selector pin end is provided with a groove adapted to receive said stop element to lock said selector in a safety position in case of accidental release of said stop element whereby said rotary member and primers are precluded from displacement to said active positions.

* * * * *